US005620021A

United States Patent [19]

Hugo

[11] Patent Number: 5,620,021

[45] Date of Patent: Apr. 15, 1997

[54] THERMAL CHECK VALVE

[75] Inventor: Richard J. Hugo, Bartlett, Tenn.

[73] Assignee: Grav-Flow, Inc., Bartlett, Tenn.

[21] Appl. No.: 524,237

[22] Filed: Sep. 6, 1995

[51] Int. Cl.[6] ..... F16K 49/00

[52] U.S. Cl. ..... 137/337; 137/533.27; 137/533.31

[58] Field of Search ..... 137/337, 533.31, 137/533.21, 533.27

[56] References Cited

U.S. PATENT DOCUMENTS

| | | | |
|---|---|---|---|
| 840,174 | 1/1907 | Tanner | 137/533.21 |
| 2,194,805 | 3/1940 | Moore | 137/533.27 |
| 2,842,155 | 7/1958 | Peters | 137/337 |
| 2,860,659 | 11/1958 | Carlson et al. | 137/533.27 |
| 3,340,899 | 9/1967 | Welty et al. | 138/43 |
| 3,428,251 | 2/1969 | Gross et al. | 236/92 |
| 3,556,124 | 1/1971 | Walton | 137/112 |
| 3,929,153 | 12/1975 | Hasty | 137/337 |
| 3,938,741 | 2/1976 | Allison | 239/75 |
| 4,191,205 | 3/1980 | Nash | 137/375 |
| 4,210,284 | 7/1980 | Tarnay et al. | 239/75 |
| 4,410,007 | 10/1983 | Karpenko | 137/516.29 |
| 4,557,252 | 12/1985 | Dinh | 126/420 |
| 4,681,088 | 7/1987 | Cromer | 126/420 |
| 5,236,010 | 8/1993 | George, II et al. | 137/534 |

FOREIGN PATENT DOCUMENTS

| | | | |
|---|---|---|---|
| 19498 | 12/1899 | Switzerland | 137/533.31 |

OTHER PUBLICATIONS

Watts Regulator Co., *Hydronic Heating Specialities Brochure*, Series 2000 Flow Check Valve 1994.

Watts Regulator Co., *Series 2000 Flow Checks Brochure* 1994.

Watts Regulator Co., *Instructions for Installing Watts No. 2000, 2000S* 1994.

Polymer Corp., *5 Things You Should Know About Polymer Corporation's General Purpose Acetal Rod and Plate Machining* (1992).

*Primary Examiner*—A. Michael Chambers

*Attorney, Agent, or Firm*—Walker, McKenzie & Walker, P.C.

[57] ABSTRACT

A thermal check valve for use in a gravity flow hot water recirculating system. The hot water system has a hot water heating tank, a water faucet, manifold piping from the hot water heating tank to the faucet, return piping from the faucet to the hot water heating tank, and a thermal check valve interposed in the return piping and adjacent a return inlet into the tank. The check valve has a valve body, an inlet chamber formed within the valve body, an inlet port in communication with the inlet chamber, an outlet chamber formed within the valve body, and an outlet port in communication with the outlet chamber, the outlet port being below the inlet port. The valve body includes a valve seat interposed between the inlet and the outlet chambers, and the check valve includes a float within the outlet chamber, the float being vertically movable onto and off of the valve seat so that the float seals the outlet chamber from the inlet chamber when the float rests upon the valve seat, and the float has a specific gravity in the range of 1.05 to 2.0. The float has a vertical bore extending thereinto from above, and a rod extends an adjustable distance into the bore so as to restrict vertical movement of the float off of the valve seat.

15 Claims, 1 Drawing Sheet

FIG. 1
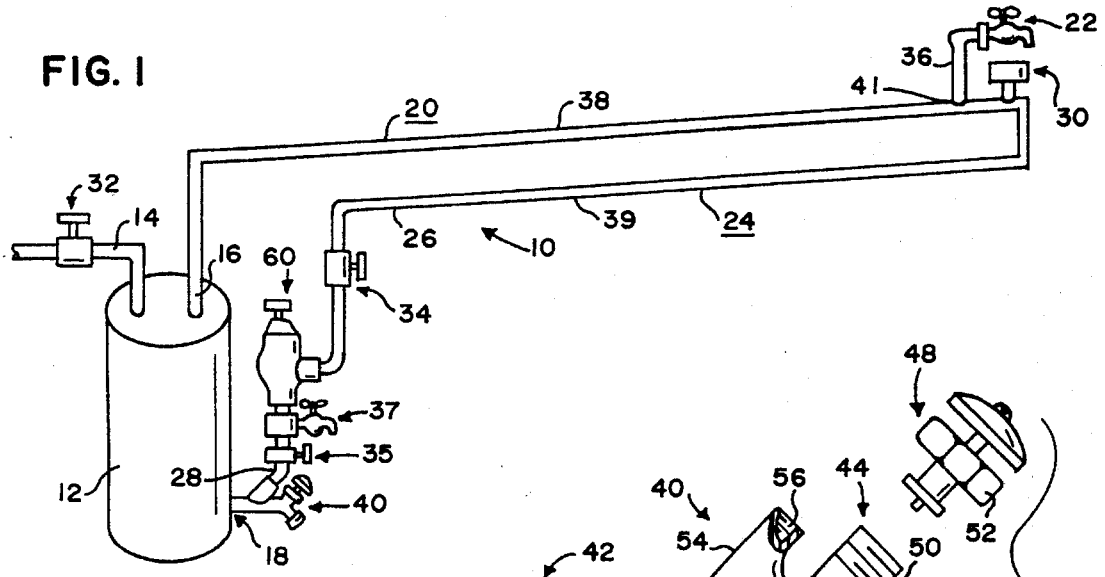
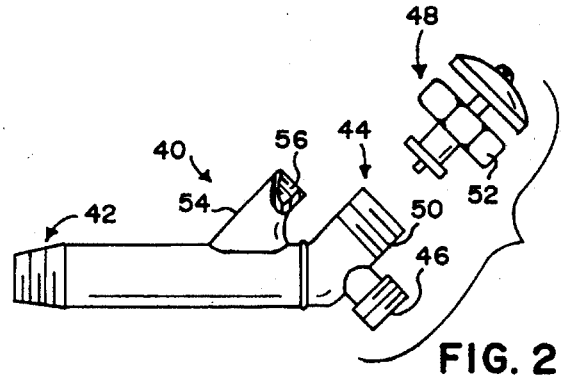
FIG. 2
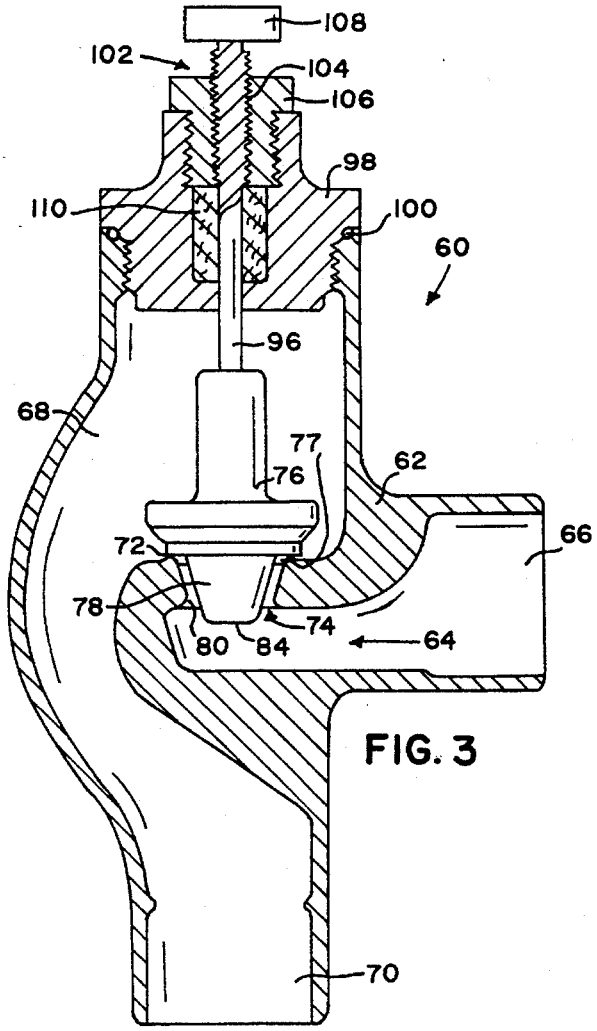
FIG. 3
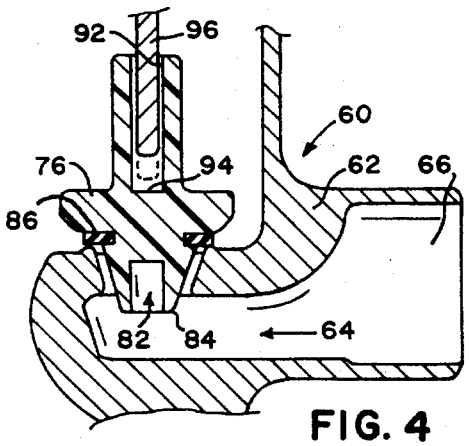
FIG. 4
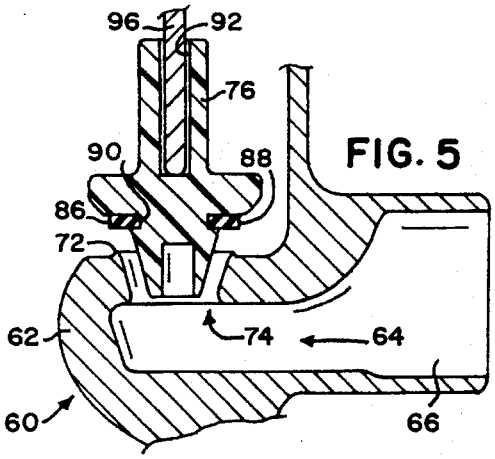
FIG. 5

THERMAL CHECK VALVE

BACKGROUND OF THE INVENTION

1. Field of the Invention

The present invention relates, in general, to plumbing, and in particular, to valves for use in hot water supply systems.

2. Information Disclosure Statement

It is often desired to have hot water flow almost instantaneously, i.e., within five seconds, from a hot water faucet after the faucet is turned on. Not only is such instantaneous supply of hot water convenient, it also is ecologically sound because little water is wasted while waiting for the water to become hot. Well-known solutions for this problem include circulating pumps to circulate hot water throughout a hot water system, multiple hot water heating tanks throughout a building, and gravity flow hot water recirculating systems that create a natural circulation of hot water throughout a building by using the natural rise of heated water and the natural sinking of water as it cools.

In such a gravity flow hot water recirculating system, heated water rises from a hot water heating tank to faucets or other fixtures at higher levels and then, as the heated water cools, it sinks and returns to the hot water heating tank through a return line.

However, when the faucets or other fixtures are opened, it is desirable that only the heated water flow to the faucets and that the cooled water in the return line not flow to the faucets. Additionally, if water in the bottom of the hot water heating tank is allowed to flow back through the return line toward the faucets, sediment within the bottom of the hot water tank will tend to be carried out of the hot water tank and into the hot water system.

It is therefore desirable to have a check valve for use in a gravity flow hot water recirculating system that can prevent the backward flow of cooled water within the return line of the system and also thus reduce the flow of sediment into the hot water system from the hot water tank.

Attempts in the prior art to create check valves to solve this problem have been found to cause "hammering" noises of water in the water pipes, and have also been found to create "heat traps" within the valves, thus disturbing the recirculating flow of hot water within the hot water system.

A preliminary patentability search in Class 137, subclasses 337 and 468, produced the following patents, some of which may be relevant to the present invention: Peters, U.S. Pat. No. 2,842,155, issued Jul. 8, 1958; Welty et al., U.S. Pat. No. 3,340,899, issued Sep. 12, 1967; Gross et al., U.S. Pat. No. 3,428,251, issued Feb. 18, 1969; Walton, U.S. Pat. No. 3,556,124, issued Jan. 19, 1971; Hasty, U.S. Pat. No. 3,929,153, issued Dec. 30, 1975; Allison, U.S. Pat. No. 3,938,741, issued Feb. 17, 1976; Tarnay et al., U.S. Pat. No. 4,210,284, issued Jul. 1, 1980; Dinh, U.S. Pat. No. 4,557,252, issued Dec. 10, 1985; and Cromer, U.S. Pat. No. 4,681,088, issued Jul. 21, 1987.

Hasty, U.S. Pat. No. 3,929,153, describes a well-known gravity flow hot water circulating system including a thermal check valve having a float with a specific gravity between 1.05 and 2.0, and the Hasty patent is fully included herewithin by reference. However, the valve disclosed in the Hasty patent does not have an outlet port below the inlet port, and thus can cause significant heat trapping within the hot water system, thereby reducing the circulation of the hot water.

The inventor is also aware of the following references, some of which may be relevant to the present invention: Nash, U.S. Pat. No. 4,191,205, issued Mar. 4, 1980; Karpenko, U.S. Pat. No. 4,410,007, issued Oct. 18, 1983; George, II, et al., U.S. Pat. No. 5,236,010, issued Aug. 17, 1993; Watts Regulator Co., Hydronic Heating Specialties Brochure, (date unknown); Watts Regulator Co., Series 2000 Flow Checks Brochure (date unknown); Watts Regulator Co., Instructions for Installing Watts No. 2000, 2000S (date unknown); and Polymer Corporation, 5 Things You Should Know About Polymer Corporation's General Purpose Acetal Rod and Plate Machining (1992).

None of these references, either singly or in combination, disclose or suggest the present invention.

SUMMARY OF THE INVENTION

The present invention is a thermal check valve for use in a recirculating gravity flow hot water system, with the valve being preferably installed within the return line of the gravity flow hot water system near the return inlet of the water heater. The valve includes a float having a specific gravity just slightly less buoyant than the liquid, typically water, that flows through the valve. The valve has an inlet port leading to an inlet chamber, an outlet port below the inlet port and leading from an outlet chamber, and the inlet and outlet chambers are separated by a valve seat from which the float rises and upon which the float rests to selectively open and close the valve. Adjusting means may be provided to limit the rise of the float above the valve seat, thus providing for control of the recirculating water.

It is an object of the present invention to provide a thermal check valve for use in a gravity flow hot water system that allows heated water to circulate from the hot water heating means to water fixtures, then through the valve and to the return inlet of a water heater of the hot water system while also preventing the substantial "backflow" of cooled water from the return inlet of the water heater, through the valve, back to the water fixtures. It is a further object of the present invention to provide a thermal check valve having reduced heat trapping therewithin than heretofore known in the prior art.

BRIEF DESCRIPTION OF THE DRAWINGS

FIG. 1 is a schematic view of the present invention installed within a gravity flow hot water recirculating system.

FIG. 2 is a view of a drain tee and the parts thereof, as may be used with the present invention.

FIG. 3 is an enlarged sectional view of the present invention.

FIG. 4 is a partial sectional view of the present invention, showing the float almost resting on the valve seat and showing the movement of the adjustable plunger.

FIG. 5 is a partial sectional view of the present invention showing the float having risen above the valve seat.

DESCRIPTION OF THE PREFERRED EMBODIMENT

Referring to FIG. 1, the thermal check valve 60 of the present invention is schematically shown installed within a gravity flow hot water circulating system 10. Hot water system 10 includes well-known water heating means 12, such as, for example, a well-known electric or gas water heating tank, for heating water supplied through a supply pipe 14 from a source of water, not shown. Water heating means 12 has a heated water outlet 16 from which heated water emerges from water heating means 12, and water heating means 12 further has a return inlet 18 below heated water outlet 16 into which cooled water recirculates back into water heating means 12. Although water is the preferred liquid for use with the check valve of the present invention, it shall be understood that the present invention could be used with other gravity flow heated liquid circulating systems, and water is used herein as a well-known example liquid.

Hot water system 10 also includes manifold piping means 20 for supplying heated water from heated water outlet 16 to one or more well-known water fixture means 22, such as a faucet, for selectively dispensing heated water from hot water system 10. Water fixture means 22 may include branch piping 36 for placing water fixture means 22 in communication with hot water system 10. Hot water system 10 further includes return piping means 24 for returning circulating water from water fixture means 22 to return inlet 18. At least a portion, and preferably substantially all, of manifold piping means 20 is slightly inclined upwardly from heated water outlet 16 to water fixture means 22 so as to allow heated water to rise, in a manner hereinafter described, from heated water outlet 16 to water fixture means 22, and, likewise, at least a portion, and preferably substantially all, of return piping means 24 is slightly inclined downwardly from water fixture means 22 to return inlet 18 so as to allow cooled water to sink, in a manner hereinafter described, from water fixture means 22 back to return inlet 18. Preferably the slope of manifold piping means 20 and return piping means 24 is approximately one inch (2.54 cm) of respective rise and fall per 100 feet (30.5 m) of length of manifold piping means 20 and return piping means 24, and it should be understood that this slope is shown exaggerated in FIG. 1 for clarity. Return piping means 24 should be at least 0.25 inch (6.35 mm) below manifold piping means 20 along all almost-horizontal runs, and, additionally, manifold piping means 20 and return piping means 24 should be inclined without having regions where either piping means goes up and down, i.e., without having local maxima, so as to ensure that no "heat traps" are created that might otherwise hinder proper circulation of the hot water within hot water system 10.

Return piping means 24 has a first portion 26 extending from water fixture means 22 and further has a second portion 28 extending toward return inlet 28 and in communication therewith. Preferably, hot water system 10 may have a well-known air venting means 30 at the highest point in the circulating system for venting trapped air from piping means 20 and 24 and thus preventing air buildup therewithin, and one or more shutoff valves 32, 34, normally kept fully open, may be provided to cut off water flow through the system during maintenance. Additionally, a maintenance valve 35 and a sediment drain valve 37 may be interposed within portion 28 of piping means 24 between valve 60 and return inlet 28 so as to provide means for draining sediment from return piping means 24 and for isolating valve 60 for repair.

Because water does not flow through branch piping 36 except when water fixture means 22 is opened to allow water to flow therefrom, any water within branch piping 36 will become cooled when no water flows out water fixture means 22 due to the fact that branch piping 36 is not part of the circuit of circulating water through piping means 20 and 24, hereinafter described. Therefore, it is important that branch piping 36 be as short as possible and not of an excessive diameter so as to minimize the volume of water within branch piping 36, thereby minimizing the volume of cooled water that must be purged through water fixture means 22 when it is first opened before hot water emerges therefrom.

Manifold piping means 20 and return piping means 24 should each be well-insulated so as to minimize the temperature gradient from water heating means 12 to water fixture means 22, and, as a practical matter, piping means 20 and 24 should each be less than 100 feet (30.5 m) in length. Otherwise, users of hot water system 10 could become scalded as the temperature of the hot water emerging from water fixture means 22 increases rapidly as water flows from water heating means 12 to water fixture means 22. For example, it has been found that there is a 0.21 degree Fahrenheit heat loss per foot of piping when that piping is insulated by so-called "insultube" insulating tubing having an insulation rating ("R-Factor") of 2.98, and it has similarly been found that there is a 0.15 degree Fahrenheit heat loss per foot of piping when that piping is instead insulated by an insulation R-Factor of 30, as might be the case between joists in a ceiling or attic of a house. For safe operation of hot water system 10 so as not to scald users, there should not be more than 15 degrees Fahrenheit of temperature difference, due to heat loss, over the total length of piping means 20 from heated water outlet 16 to the intersection 41 of branch piping 36 with manifold piping means 20, and sufficient insulation must be provided for both piping means 20 and 24 to ensure operation within this safety limit.

Preferably, manifold piping means 20 will be no more than 18 feet (5.49 m) above the bottom of water heating means 12. Otherwise, hydrostatic pressures may impede proper circulation of hot water within hot water system 10. Furthermore, the slightly inclined and almost-horizontal portions 38 and 39 of piping means 20 and 24, respectively, should be at least 5 feet (1.5 m) above thermal check valve 60, and hot water heating means 12 should be at the lowest point of hot water system 10. Interposed between first and second portions 26 and 28 of return piping means 24 and substantially adjacent return inlet 18 is the thermal check valve 60 of the present invention, hereinafter described in detail. Thermal check valve 60 should preferably be installed about 18 inches (46 cm) above the bottom of water heating means 12 so that check valve 60 will be above any sediment within water heating means 12.

Return inlet 18 of hot water heating means 12 is fitted with a "drain tee" 40, whose construction is shown in FIG. 2. Drain tee 40 has a threaded first end 42 that is threadedly received into what otherwise would be the drainage port of hot water heating means 12, but, in hot water system 10, the drainage port of hot water heating means 12 serves as the return inlet 18 for return of cooled water back into hot water heating means 12 for subsequent reheating. Drain tee 40 has a well-known faucet 44 having an outlet 46, with faucet 44 having well-known adjustable screw valve means 48 for selectively allowing water to flow through drain tee 40 and out of outlet 46, screw valve means 48 being received into the body of drain tee 40 and secured by a cap 52 to threads 50 of drain tee 40.

Drain tee 40 also has an angled fitting 54, preferably angled upwardly at 45 degrees with respect to the axis of drain tee 40, having internal threads 56 for threadedly receiving portion 28 of return piping means 24. Drain tee 40 shall be understood to have a longitudinal bore open at end 42 and in communication with angled fitting 54, thereby placing portion 28 of return piping means 24 in communication with return inlet 18 of hot water heating means 12. It shall also be now understood that the longitudinal bore of drain tee 40 is selectively in communication with faucet outlet 46, depending on whether screw valve means 48 is open or closed. Periodically, sediment within hot water heating means 12 may be purged by closing valve 34, shown in FIG. 1, and then turning on faucet 44 by opening screw valve means 48, in a manner well known to those skilled in the art. Then, by closing maintenance valve 35, opening valve 34, and then opening sediment drain valve 37, sediment may be drained from thermal check valve 60 and piping means 20 and 24. The system may then be restored to normal operation by closing valve 37 and opening maintenance valve 35.

Referring again to FIG. 1, as water is heated, its density, as measured in pounds per cubic foot, changes. A typical temperature for hot water emerging from heated water outlet 16 is 125 degrees Fahrenheit and, at such a temperature, water has a density of 61.635 pounds per cubic foot. Assuming, as is often the case for a hot water system such as that shown in FIG. 1, that there is a 15 degree Fahrenheit ambient heat loss over the length of manifold piping means 20 and return piping means 24, the water temperature at return inlet 18 will be 110 degrees Fahrenheit and, at such a temperature, water has a density of 61.86 pounds per cubic foot. The lighter, hotter water will rise from water outlet 16 toward fixture means 22 and the heavier, cooler water will sink by gravity from fixture means 22 toward return inlet 18, thereby establishing a circulating condition within hot water system 10.

The changes in water density are summarized in Table I, below, from *The Design of Gravity-Circulation Water Heating Systems* by F. E. Giesecke, Ph.D. (1926).

TABLE I

DENSITY OF WATER AT VARIOUS TEMPERATURES

| Temp. °F. | Density, lbs/ft$^3$ | Temp. °F. | Density, lbs/ft$^3$ | Temp. °F. | Density, lbs/ft$^3$ |
|---|---|---|---|---|---|
| 32 | 62.42 | 92 | 62.10 | 152 | 61.16 |
| 34 | 62.42 | 94 | 62.06 | 154 | 61.12 |
| 36 | 62.42 | 96 | 62.02 | 156 | 61.08 |
| 38 | 62.43 | 98 | 62.03 | 158 | 61.04 |
| 40 | 62.43 | 100 | 62.00 | 160 | 61.00 |
| 42 | 62.43 | 102 | 61.98 | 162 | 60.96 |
| 44 | 62.42 | 104 | 61.95 | 164 | 60.92 |
| 46 | 62.42 | 106 | 61.92 | 166 | 60.88 |
| 48 | 62.41 | 108 | 61.89 | 168 | 60.84 |
| 50 | 62.41 | 110 | 61.86 | 170 | 60.80 |
| 52 | 62.40 | 112 | 61.83 | 172 | 60.76 |
| 54 | 62.39 | 114 | 61.80 | 174 | 60.71 |
| 56 | 62.39 | 116 | 61.77 | 176 | 60.67 |
| 58 | 62.38 | 118 | 61.74 | 178 | 60.62 |
| 60 | 62.37 | 120 | 61.71 | 180 | 60.58 |
| 62 | 62.36 | 122 | 61.68 | 182 | 60.54 |
| 64 | 62.35 | 124 | 61.65 | 184 | 60.49 |
| 66 | 62.33 | 126 | 61.62 | 186 | 60.45 |
| 68 | 62.32 | 128 | 61.59 | 188 | 60.40 |
| 70 | 62.30 | 130 | 61.55 | 190 | 60.36 |
| 72 | 62.29 | 132 | 61.52 | 192 | 60.31 |
| 74 | 62.27 | 134 | 61.49 | 194 | 60.26 |
| 76 | 62.26 | 136 | 61.45 | 196 | 60.22 |
| 78 | 62.24 | 138 | 61.42 | 198 | 60.17 |
| 80 | 62.22 | 140 | 61.38 | 200 | 60.12 |
| 82 | 62.20 | 142 | 61.35 | 202 | 60.07 |
| 84 | 62.18 | 144 | 61.31 | 204 | 60.02 |
| 86 | 62.16 | 146 | 61.28 | 206 | 59.98 |
| 88 | 62.14 | 148 | 61.24 | 208 | 59.93 |
| 90 | 62.12 | 150 | 61.20 | 210 | 59.88 |

Because these changes in density are so slight, it is essential that the check valve 60 not require significant force to allow water to flow through the valve, but, at the same time, the valve should substantially prevent backward flow from water heating means 12 back into return piping means 24.

Referring to FIGS. 3–5, the detailed structure of thermal check valve 60 of the present invention can now be explained.

Check valve 60 includes a valve body 62, preferably of a metal such as bronze. Valve body 62 has an inlet chamber 64 formed therewithin, an inlet port 66 in communication with inlet chamber 64, an outlet chamber 68 formed within valve body 62, and an outlet port 70 in communication with outlet chamber 68. Inlet and outlet ports 66 and 70 are sized for respective receipt of portions 28 and 26 of return piping means 24, and each of ports 66 and 70 preferably has an inner diameter of 0.75 inches (1.91 cm), milled so as to allow copper piping to be sweat-soldered within the ports to valve body 62.

Because experiments by the inventor have indicated some "heat trapping" by prior art check valves, outlet port 70 is below inlet port 66 so that "heat trapping" is reduced within valve 60 because of the horizontal to downwardly vertical flow of water through valve 60, and inlet and outlet chambers 64 and 68 are preferably smoothly curved so as to minimize turbulence within valve 60 that might otherwise impede the flow of water therethrough.

Valve body 62 includes a valve seat 72 interposed between inlet chamber 64 and outlet chamber 68, and valve body 62 has a substantially vertical passageway 74 between inlet and outlet chambers 64 and 68 and encircled by valve seat 72, with inlet chamber 64 being in communication with outlet chamber 68 only through passageway 74.

Check valve 60 further includes a float 76 within outlet chamber 68, with float 76 being vertically movable onto and off of valve seat 72 so that float 76 seals outlet chamber 68 from inlet chamber 64 by sealing passageway 74 when float 76 rests upon valve seat 72 at upper end 77 of passageway 74. Float 76 is preferably cylindrically symmetric as shown, and is slightly non buoyant, i.e., has a specific gravity in the range 1.05 to 2.0 relative to the liquid passing through valve 60 (e.g., relative to water, which has a specific gravity of 1.0). Float 76 is preferably constructed of a thermoplastic material that can withstand a temperature range of 40 to 180 degrees Fahrenheit, and a suitable material for float 76 has been found to be acetal stock sold under the trademark ACETRON GP by the Polymer Corporation, 2120 Fairmont Ave., Reading, Pa. 19612-4235, having been tested as having a specific gravity at 25 degrees Centigrade of 1.229 relative to water. Float 76 further has a downwardly-extending tapered portion 78 having a generally frusto-conical shape and extending into lower end 80 of passageway 74 so as to guide float 76 into passageway 74, with the walls of passageway 74 being also preferably tapered so that lower end 80 of passageway 74 is somewhat narrower than upper end 77 of passageway 74. Preferably, float 76 has a downwardly-facing cavity 82 open to float bottom 84 and extending upwardly from float bottom 84 and into float 76 so as to reduce the mass of float 76 and enable the gentle pressures of the flowing water to lift float 76 off of valve seat 72, perhaps also entrapping air within cavity 82 so as to slightly increase the buoyancy of float 76.

Float 76 has a downwardly-facing extended surface 86 in alignment with valve seat 72 and co-extensive therewith, and float 76 further includes a resilient rubber sealing washer 88, seated upon downwardly-facing surface 86 and constrictingly seated within a circumferential channel 90 encircling float 76 adjacent surface 86. Washer 88 should be made of rubber that can withstand the high temperatures, e.g., 180 degrees Fahrenheit, that are experienced within valve 60.

Float 76 has a substantially vertical bore 92 extending thereinto from above and terminating within float 76 at a bore end 94. Check valve 60 includes a rod 96 extending substantially vertically downwardly within outlet chamber 68 in alignment with vertical bore 92 and further extending downwardly into vertical bore 92 and being received therewithin. Valve body 62 has a valve housing cap 98 threadedly received into valve body 62 and sealed thereto by a circumferential "O"-ring 100, thereby preventing water from seeping past valve housing cap 98. Valve 60 further includes adjustment means, such as screw means 102 comprising external threads 104 upon rod 96 received within internally-threaded packing nut 106 threadedly received into housing cap 98, for adjusting rod 96 to extend a selected distance vertically toward bore end 94 so that rod 96 may restrict the vertical movement of float 76 off of valve seat 72 to a maximum height where rod 96 contacts bore end 94 as shown in FIG. 5. By turning knob 108, rod 96 is caused to extend and retract toward bore end 94 as shown in FIG. 4, thereby permitting check valve 60 to be fully closed or to be partially opened. If check valve 60 is only partially opened, the circulating water flow can be controlled, if desired.

Additionally, experiments by the inventor have shown that the vertically-constrained float movement encouraged by rod 96 within bore 92 substantially eliminates "hammering" noises that can plague prior art check valves.

Valve 60 also preferably has bonnet stem packing 110, preferably of non-porous packing gland material that will compress under pressure, compressively held within valve 60 by packing nut 106 so as to prevent water seepage past rod 96.

To use the valve 60 of the present invention, it is installed within the hot water system 10 as heretofore described, interposed within return piping means 24 and adjacent return inlet 18 but preferably 18 inches (46 cm) thereabove so as to prevent the flow of sediment within the bottom of water heating means 12 into valve 60. Water system 10 should then be bled of air, in a manner well-known to those skilled in the art, and water heating means 12 should then be energized to heat the water to a desired safe temperature. Water will begin circulating within the hot water system 10, providing substantially immediate access to hot water at faucets throughout water system 10, and valve 60 will permit the circulation of hot water while preventing backflow from return inlet back into return piping means 24.

Although the present invention has been described and illustrated with respect to a preferred embodiment and a preferred use therefor, it is not to be so limited since modifications and changes can be made therein which are within the full intended scope of the invention.

I claim:

1. A thermal check valve for selectively gating a liquid flowing therethrough, said check valve comprising a valve body, said valve body having:

(a) an inlet chamber formed within said valve body;

(b) an inlet port in communication with said inlet chamber;

(c) an outlet chamber formed within said valve body; and (d) an outlet port in communication with said outlet chamber, said outlet port being below said inlet port;

said valve body including:

(e) a valve seat interposed between said inlet chamber and said outlet chamber;

and said check valve further comprising:

(f) a float within said outlet chamber, said float being vertically movable onto and off of said valve seat within said outlet chamber so that said float seals said outlet chamber from said inlet chamber when said float rests upon said valve seat, said float having a specific gravity in the range of 1.05 to 2.0 relative to said liquid.

2. The thermal check valve as recited in claim 1, in which said valve body has a substantially vertical passageway between said inlet chamber and said outlet chamber and said inlet chamber is in communication with said outlet chamber only through said passageway so that said float seals said passageway when said float rests upon said valve seat; said passageway having an upper end within said outlet chamber and said passageway having a lower end within said inlet chamber.

3. The thermal check valve as recited in claim 2, in which said float has a substantially vertical bore extending thereinto from above and terminating within said float at a bore end; and said check valve further comprises a rod extending substantially vertically downwardly within said outlet chamber in alignment with said vertical bore and further extending downwardly into said vertical bore and being received therewithin.

4. The thermal check valve as recited in claim 3, in which said thermal check valve further includes means for adjusting said rod to extend a selected distance vertically toward said bore end so that said rod may restrict vertical movement of said float off of said valve seat.

5. The thermal check valve as recited in claim 2, in which said float has a downwardly-extending tapered lower portion extending into said lower end of said passageway.

6. The thermal check valve as recited in claim 5, in which said lower portion of said float has a float bottom and said float further has a downwardly-facing cavity open to said float bottom and extending upwardly from said float bottom and into said float.

7. A thermal check valve for selectively gating a liquid flowing therethrough, said check valve comprising a valve body, said valve body having:

(a) an inlet chamber formed within said valve body;

(b) an inlet port in communication with said inlet chamber;

(c) an outlet chamber formed within said valve body;

(d) an outlet port in communication with said outlet chamber, said outlet port being below said inlet port; and (e) a vertical passageway between said inlet chamber and said outlet chamber, said inlet chamber being in communication with said outlet chamber only through said passageway, said passageway having an upper end within said outlet chamber and said passageway having a lower end within said inlet chamber;

said valve body including:

(f) a valve seat interposed between said inlet chamber and said outlet chamber;

said check valve further comprising:

(g) a float within said outlet chamber, said float being vertically movable onto and off of said valve seat within said outlet chamber so that said float seals said passageway when said float rests upon said valve seat, said float having a specific gravity in the range of 1.05 to 2.0 relative to said liquid, said float having a substantially vertical bore extending thereinto from above and terminating within said float at a bore end; said float having a downwardly-facing surface in alignment with said valve seat and co-extensive therewith; and said float including a sealing washer upon said downwardly-facing surface in co-extensive mating alignment with said valve seat;

(h) a rod extending substantially vertically downwardly within said outlet chamber in alignment with said vertical bore and further extending downwardly into said vertical bore and being received therewithin;

(i) screw means for screwingly adjusting said rod to extend a selected distance vertically toward said bore end so that said rod may restrict vertical movement of said float off of said valve seat.

8. The thermal check valve as recited in claim 7, in which said float has a downwardly-extending tapered lower portion extending into said lower end of said passageway.

9. The thermal check valve as recited in claim 8, in which said lower portion of said float has a float bottom and said float further has a downwardly-facing cavity open to said float bottom and extending upwardly from said float bottom and into said float.

10. An improved gravity flow hot water system, said hot water system having:

(a) water heating means for heating water, said water heating means having a heated water outlet and also having a return inlet below said heated water outlet;

(b) water fixture means for selectively dispensing heated water from said hot water system;

(c) manifold piping means for supplying heated water from said heated water outlet to said water fixture means, at least a portion of said manifold piping means being inclined upwardly from said heated water outlet to said water fixture means; and (d) return piping means for returning water from said water fixture means to said return inlet, at least a portion of said return piping means being inclined downwardly from said water fixture means to said return inlet, said return piping means having a first portion extending from said water fixture means and said return piping means having a second portion extending toward said return inlet and in communication therewith;

wherein the improvement comprises a thermal check valve interposed in said return piping means between said first and said second portions of said return piping means substantially adjacent said return inlet and vertically thereabove, said check valve comprising a valve body, said valve body having:

(e) an inlet chamber formed within said valve body;

(f) an inlet port in communication with said inlet chamber and said first portion of said return piping means;

(g) an outlet chamber formed within said valve body; and (h) an outlet port in communication with said outlet chamber and said second portion of said return piping means, said outlet port being below said inlet port;

said valve body including:

(i) a valve seat interposed between said inlet chamber and said outlet chamber;

and said check valve further comprising:

(j) a float within said outlet chamber, said float being vertically movable onto and off of said valve seat within said outlet chamber so that said float seals said outlet chamber from said inlet chamber when said float rests upon said valve seat, said float having a specific gravity in the range of 1.05 to 2.0 relative to water.

11. The improved gravity flow hot water system as recited in claim 10, in which said valve body has a substantially vertical passageway between said inlet chamber and said outlet chamber and said inlet chamber is in communication with said outlet chamber only through said passageway so that said float seals said passageway when said float rests upon said valve seat; said passageway having an upper end within said outlet chamber and said passageway having a lower end within said inlet chamber.

12. The improved gravity flow hot water system as recited in claim 11, in which said float has a substantially vertical bore extending thereinto from above and terminating within said float at a bore end; and said check valve further comprises a rod extending substantially vertically downwardly within said outlet chamber in alignment with said vertical bore and further extending downwardly into said vertical bore and being received therewithin.

13. The improved gravity flow hot water system as recited in claim 12, in which said thermal check valve further includes means for adjusting said rod to extend a selected distance vertically toward said bore end so that said rod may restrict vertical movement of said float off of said valve seat.

14. The improved gravity flow hot water system as recited in claim 13, in which said float has a downwardly-extending tapered lower portion extending into said lower end of said passageway.

15. The improved gravity flow hot water system as recited in claim 14, in which said lower portion of said float has a float bottom and said float further has a downwardly-facing cavity open to said float bottom and extending upwardly from said float bottom and into said float.

* * * * *